US005491467A

United States Patent [19]

Tracy et al.

[11] Patent Number: 5,491,467

[45] Date of Patent: Feb. 13, 1996

[54] LOCATION INDEPENDENT INTRUSION DETECTION SYSTEM

[75] Inventors: Lawrence R. Tracy, Auburn; Frederick W. Eggers, Dixon; David Houston, Sacramento; Walter B. Wallace, Granite Bay; Jeffrey Bamford, El Dorado Hills, all of Calif.

[73] Assignee: C & K Systems, Inc., Folsom, Calif.

[21] Appl. No.: 189,419

[22] Filed: Jan. 31, 1994

[51] Int. Cl.[6] ..... G08B 13/19; G08B 13/24

[52] U.S. Cl. ..... 340/522; 340/554; 340/567

[58] Field of Search ..... 340/522, 554, 340/567

[56] References Cited

U.S. PATENT DOCUMENTS

| | | | |
|---|---|---|---|
| 4,710,750 | 12/1987 | Johnson | 340/552 |
| 5,017,783 | 5/1991 | Mousavi | 250/353 |
| 5,023,594 | 6/1991 | Wallace | 340/552 |
| 5,221,919 | 6/1993 | Hermans | 340/567 |
| 5,331,308 | 7/1994 | Buccola et al. | 340/552 |

OTHER PUBLICATIONS

U.S. patent application Ser. No. 07/817,339, filed Jun. 1, 1992, Wallace.

*Primary Examiner*—Glen Swann

*Attorney, Agent, or Firm*—Ronald L. Yin; Limbach & Limbach

[57] ABSTRACT

A dual technology intrusion detection device has a microwave detection sub-system, employing a bent mono-pole as an antenna to generate a symmetrical conically shaped volume of protection. The intrusion detection system also has a passive infrared intrusion detection sub-system, employing a hemispherically shaped fresnel lens having a plurality of lens segments, to detect infrared radiation from a plurality of spaced apart fields of view in a right symmetrical cone. The volume of protection for the infrared intrusion detector and microwave detector substantially coincide. In addition, the microwave detection sub-system employs a single bipolar transistor and a variable trim capacitor to generate the microwave energy and also uses the single bipolar transistor in an autodyne mode to mix the received microwave radiation.

4 Claims, 5 Drawing Sheets

LOCATION INDEPENDENT INTRUSION DETECTION SYSTEM

TECHNICAL FIELD

The present invention relates to an intrusion detection system which can be placed virtually anywhere in an enclosed spaced, and more particularly to a location independent intrusion detection system having false alarm immunity.

Background of The Invention

Volume protection intrusion detection systems, such as burglar alarms, to detect intrusion in a substantially enclosed space, such as a room, are well known in the art. Typically the intrusion detection system includes presence and/or motion detectors. Two general types of detectors are used: passive and active. An example of a passive detector is a passive infrared detector which detects the presence and/or motion of infrared radiation generated by an intruder within a defined area to be protected. In the prior art, infrared intrusion detectors employ a plurality of segmented mirrors or lenses to gather infrared radiation from a plurality of spaced apart fields of view ("finger-like" projections) from a volume of space. A passive infrared intrusion detector employing a dome shaped fresnel lens and fresnel prism to refract and to focus radiation from a plurality of spaced apart fields of view from a 360 degree zone is disclosed in U.S. Pat. No. 5,017,783, assigned to the present assignee.

An example of an active detector is a microwave transceiver. The transceiver transmits and receives microwave radiation having frequencies greater than 1 Gigahertz, to detect the presence and/or motion of an object within the defined area to be protected. Microwave transceivers employing bent monopole antennas are also well known in the art. Microwave transceivers with bent monopole antennas are able to detect intruders in a volume of space, which is substantially conically shaped, with the axis of cone perpendicular to the plane of radiation of the monopole antenna. In addition, the prior art discloses a ceiling mounted microwave transceiver with 360 degree radiation pattern. See U.S. Pat. No. 5,023,594, assigned to the present assignee. The microwave radiation pattern as disclosed in that reference however, has a spatulate radial cross section pattern.

In the prior art, it is also known to use a single bipolar transistor as the active element in the oscillator portion of the microwave transceiver for transmission and detection of the reflected microwave radiation. However, in the prior art the single bipolar transistor is used with a dielectric resonator, which is expensive.

Finally, in U.S. patent application Ser. No. 07/817,339 filed on Jun. 1, 1992, and assigned to the present assignee, a single bipolar transistor with a UHF trimmer capacitor is used in the oscillator section of the microwave transceiver. However, in that application, a Schottky diode is used in the receiver section to mix the microwave radiation. A Schottky diode is an active element which can also be expensive.

An intrusion detection system employing dual technology, such as the combination of passive infrared and microwave are also known in the art. By using the combination of two detectors to detect the present of an intruder before an alarm signal is generated, false alarms are minimized. However, in order for the intrusion detection system using dual technology to operate properly, both detectors must be aligned to be directed at substantially the same volume of space. Since the volume of space to which each of the detectors is designed to protect may vary, the location of the dual technology intrusion detection system to protect the enclosed volume of space becomes important.

Thus, there is a need for an intrusion detection system, employing dual technology sensors, which is low cost, and which can be positioned virtually anywhere in an enclosed volume of space.

SUMMARY OF THE INVENTION

The present invention relates to a location independent intrusion detection system, which comprises a passive infrared radiation (PIR) intrusion detection means for sensing the infrared radiation of an intruder. The PIR detection means comprises a substantially hemispherically shaped fresnel lens having a plurality of fresnel lens segments, with each lens segment focusing infrared radiation from a field of view. The plurality of fresnel lens segments focus infrared radiation gathered from a plurality of spaced apart fields of view from a substantially conically shaped volume of space. The conically shaped volume of space has an axis, perpendicular to the plane of the PIR intrusion detection means, and the volume of space is symmetrical about the axis. The intrusion detection system also has a microwave transceiver means, which has a microwave generating means for generating microwave radiation, and a bent monopole antenna for radiating the microwave radiation generated by the microwave generating means. The bent monopole antenna radiates the microwave into a substantially balloon shaped symmetrical volume of space, with the volume of space having an axis, substantially perpendicular to the plane of the microwave transceiver means. The balloon shaped volume of space of the microwave transceiver means substantially coincides with the conically shaped volume of space of the PIR intrusion detection means.

DETAILED DESCRIPTION OF THE PREFERRED EMBODIMENT

Figure 1:
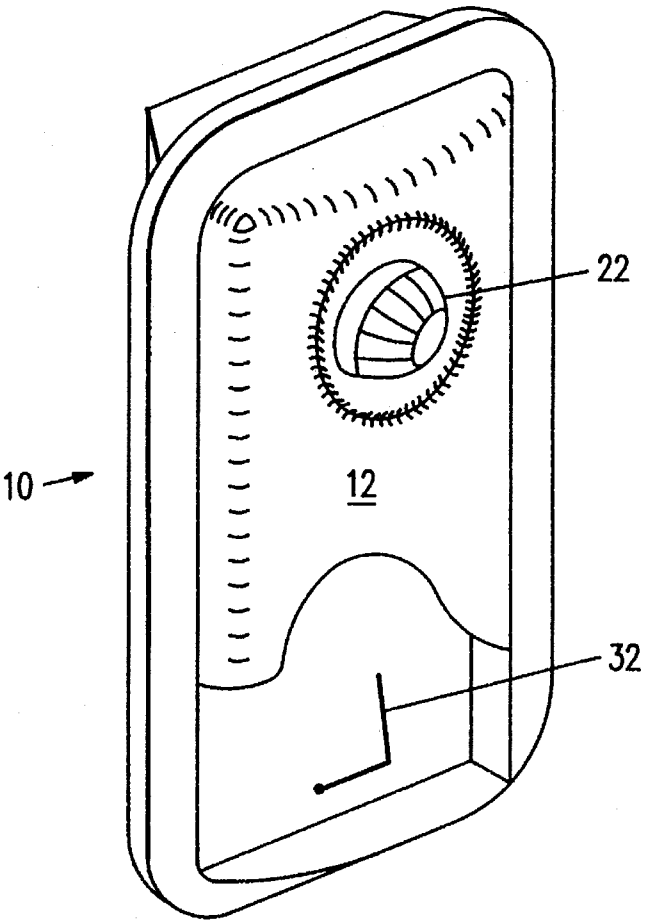
FIG. 1 is a perspective partially cut away view, of the intrusion detection system of the present invention.
Figure 8:
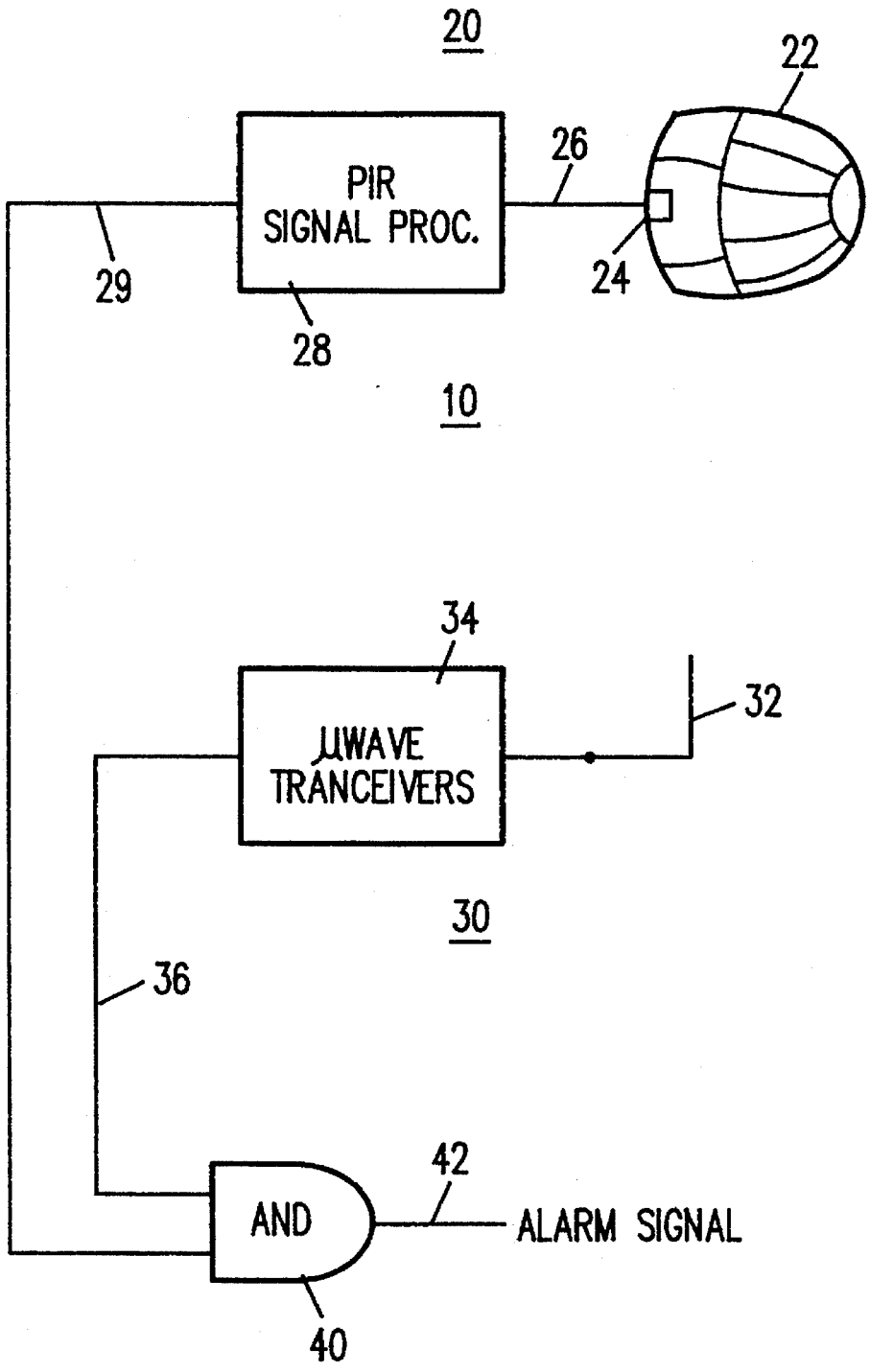
FIG. 8 is a block level diagram of the two detection sub-systems (Passive infrared and microwave) that comprise the intrusion detection system of the present invention.

Referring to FIG. 1 there is shown a perspective view of an intrusion detection system 10 of the present invention. The intrusion detection system 10 comprises a passive infrared radiation (PIR) intrusion detection sub-system 20, shown in FIG. 8. The PIR intrusion detection sub-system 20 comprises a hemispherically shaped fresnel lens 22, having a plurality of segments (discussed in greater detail hereinafter) to gather and focus infrared radiation detected from a plurality of spaced apart views. The infrared radiation gathered by the lens 22 are focused onto a PIR detector 24, which is of conventional design. The PIR detector 24 generates a signal 26 which is processed by a PIR signal processing circuit 28 which is also of conventional design. The output of the PIR signal processing circuit 28 is a PIR detect signal 29.

The intrusion detection system 20 also comprises a microwave intrusion detection sub-system 30. The microwave intrusion detection sub-system 30 comprises a bent mono-pole antenna 32, which transmits microwave radiation into a volume of space, and detects the doppler shifted radiation therefrom. The bent mono-pole antenna 32 is a mono-pole antenna having a right angle bent therein. The antenna 32 is connected to a microwave transceiver 34, which generates the microwave radiation radiated by the antenna 32, and processes the microwave radiation detected by the antenna 32. The microwave transceiver generates a microwave detect signal 36. The PIR detect signal 29 and the microwave detect signal 36 are supplied to an AND gate 40, which generates an alarm signal 42 in response to the presence of both PIR detect signal 29 and the microwave detect signal 36.

Figure 2:
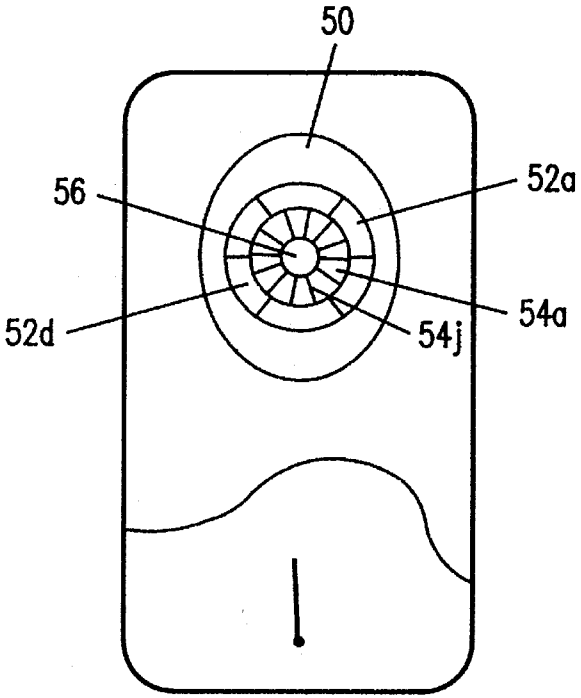
FIG. 2 is a frontal view of the intrusion detection system shown in FIG. 1.

The hemispherically shaped fresnel lens 22 is shown in greater detail in FIG. 2. As shown in FIG. 2, the lens 22 is positioned in a cavity 50 in the frontal side 12 of the housing containing the intrusion detection system 10. The lens 22 comprises a plurality of segments arranged in three tiers. An outermost tier 52 of lens segments (comprising of six lens segments (*a–f*)) is positioned circumferentially about the outer circumference of the lens 22. A second tier 54 of lens segments (comprising of ten lens segments (*a–j*)) is positioned immediately inward from the outermost tier 52. Finally, a single lens 56 is positioned substantially at the center of the hemispherically shaped lens 22.

Figure 4:
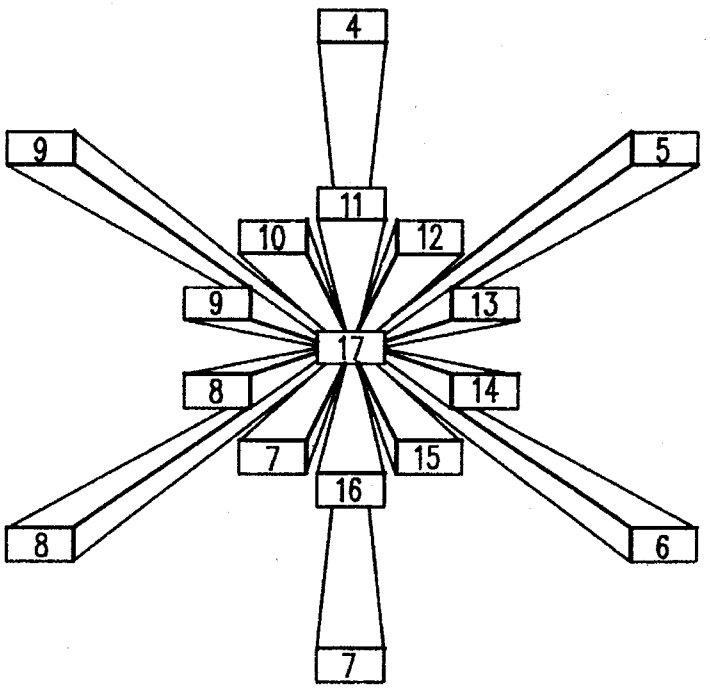
FIG. 4 is a frontal view of the plurality of spaced apart fields of view of the detection pattern shown in FIG. 3.
Figure 3:
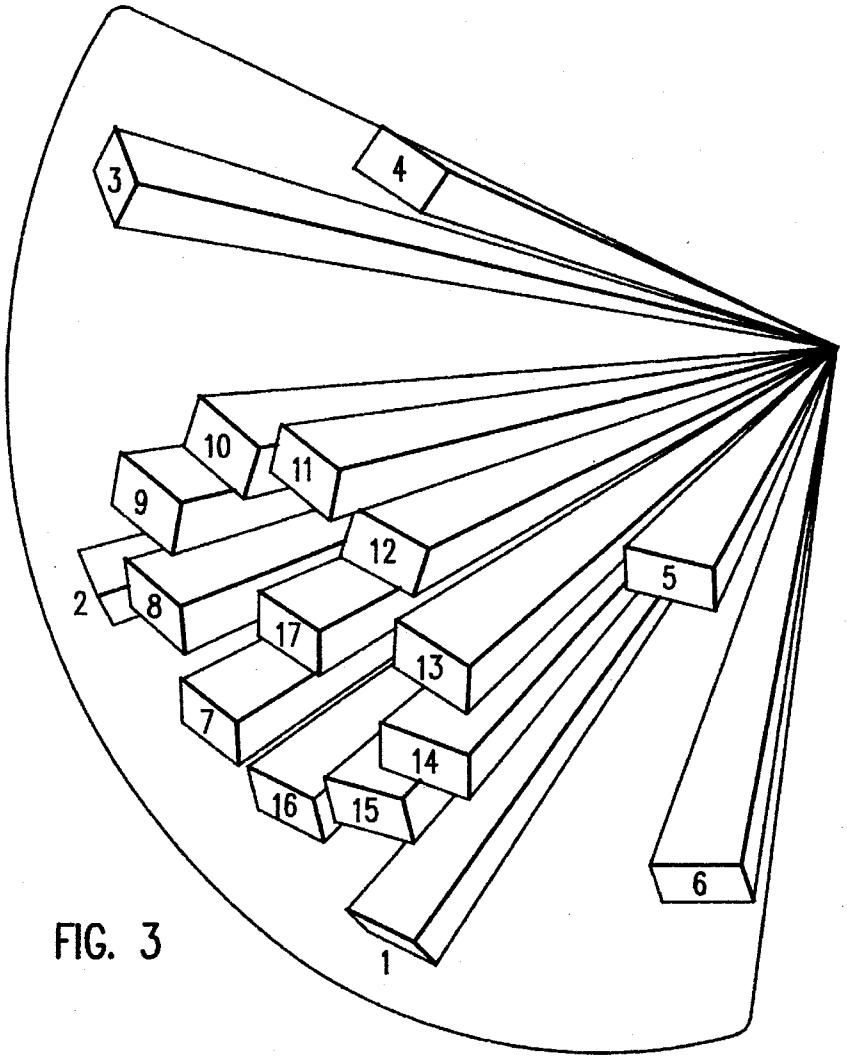
FIG. 3 is a perspective view of the plurality of spaced apart fields of view of infrared radiation detected by the PIR sensor portion of the intrusion detection system of the present invention.

Collectively the lens segments 52(*a–f*), 54(*a–j*), and 56 detect a plurality (17) of spaced apart fields of view, which form a substantially right cone shaped volume of space. The conically shaped volume of space is shown in FIG. 3. The conically shaped volume of space has an axis which is substantially perpendicular to the frontal surface 12, with the plurality of spaced apart fields of view detected by the PIR detection sub-system 20 being symmetrical about the axis of the cone. As shown in FIG. 4, the seventeen spaced apart fields of view are labeled as 1–17 with the following correspondence between the fields of view and the lens segments:

lens 52(*a–f*)—fields of view 1–6 lens 54(*a–j*)—fields of view 7–16 lens 56—fields of view 17.

Figure 5:
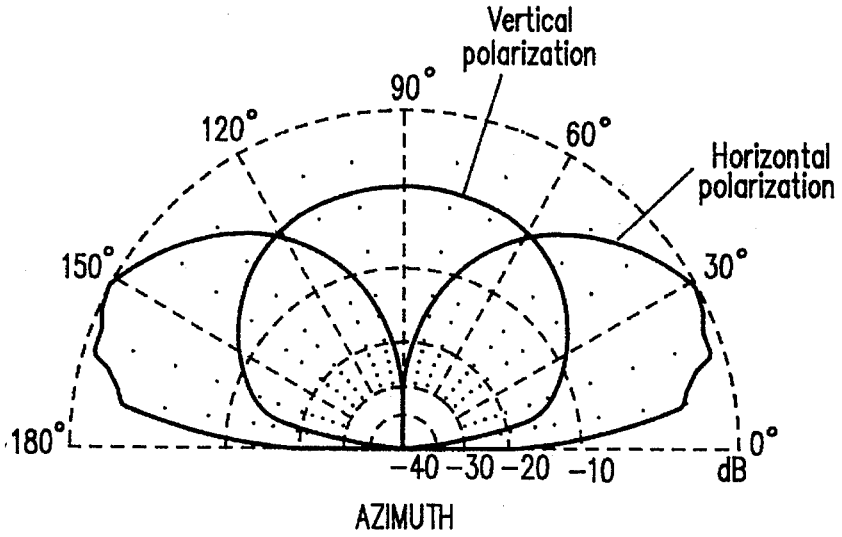
FIG. 5 is a side view of the microwave radiation pattern generated and detected by the microwave transceiver portion of the intrusion detection system of the present invention.

As previously discussed, the intrusion detection system 10 also comprises a microwave detection subsystem 30, having a bent monopole antenna 32. The bent monopole antenna is also shown in FIG. 1, wherein the antenna has a portion parallel to the plane defined by the front surface 12, and a portion which is perpendicular to the front surface 12. The radiation pattern of the antenna 32 is shown in FIG. 5, which is a side view of the radiation pattern. As can be seen in FIG. 5, the radiation pattern of the bent mono-pole antenna 32 comprises a central portion which is substantially in the shape of a balloon, being symmetrical about a central axis perpendicular to the front surface 12. In addition, the pattern also comprises a substantially toroidally shaped volume of space having a spatulate like cross section.

Because the volume of protection of both the microwave detection sub-system 30 and the PIR detection sub-system 20 are symmetrical about an axis perpendicular to the frontal surface 12, and are substantially conically shaped, the intrusion detection device 10 can be placed virtually anywhere in an enclosed space, such as a room. Thus, the intrusion detector 10 can be placed, for example, along the ceiling, or at any height along a wall, or even on the floor. In addition, since the volumes of protection for the two different technologies substantially coincide, the two different sub-systems can be aligned at the factory, with no alignment required during installation.

Figure 6:
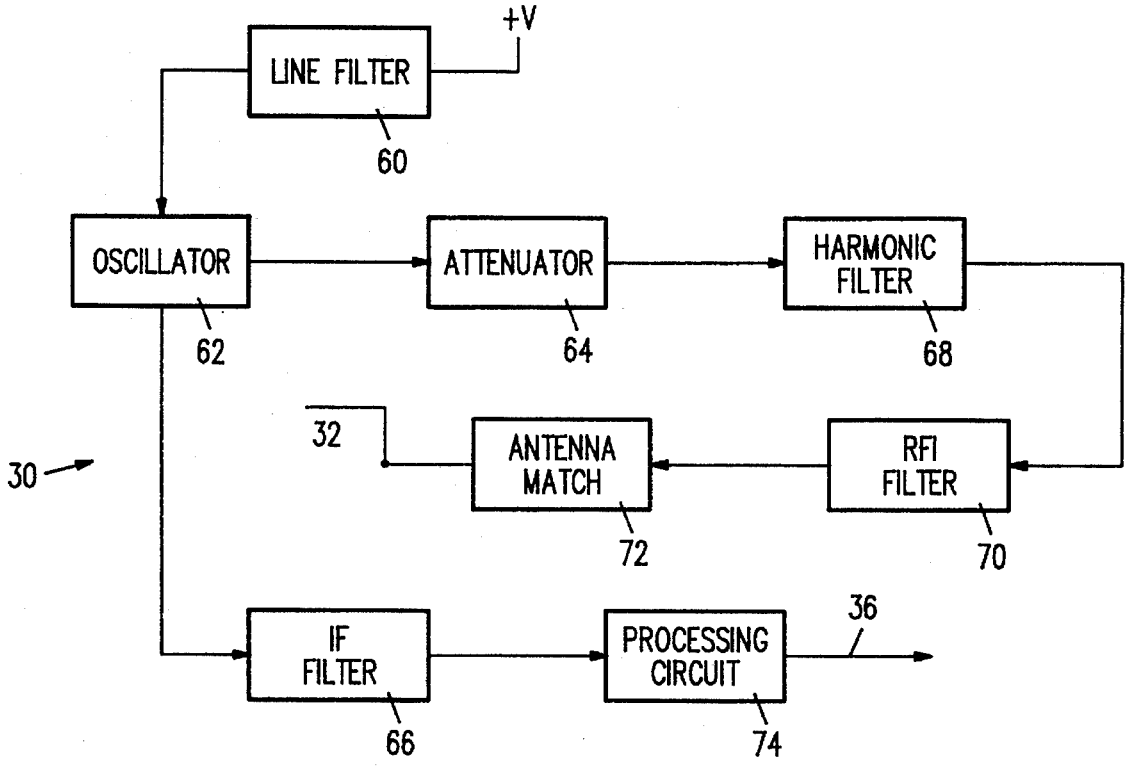
FIG. 6 is a block diagram of the circuit of the microwave detection portion of the intrusion detection system of the present invention.

The microwave detection sub-system 30 comprises the bent mono-pole antenna 32 and a microwave transceiver 34, as seen in FIG. 6. The microwave transceiver 34 comprises an oscillator 62, which is a self detect or autodyne oscillator, which both generates the microwave energy and mixes the received microwave energy. The oscillator 62 is supplied with a source of filtered power supply from the line filter 60. The microwave energy generated by the oscillator 62 is supplied to an attenuator circuit 64.

The attenuator circuit 64 reduces the power of the microwave energy before the energy is delivered to the harmonic filter 68. The attenuator circuit 64 provides isolation between the antenna 32 and the oscillator 62. From the harmonic filter 68, the microwave energy signal is supplied to an Radio Frequency Interference RFI filter 70. The RFI filter 70 rejects the lower radio frequency signals that might be present in the environment detected by the antenna 32, thereby reducing the possibility of false alarm.

The microwave energy from the RFI filter 70 is then supplied to the antenna match circuit 72, which is then supplied to the antenna 32.

The microwave detection sub-system 30 utilizes a microstrip transmission line, rather than a waveguide, to carry microwave electromagnetic energy. While the planar microwave transceiver 34 utilizes a microstrip transmission line, it should be understood that other strip conductor transmission lines, such as stripline, may be used. Microwave energy is able to propagate along the microstrip line due to the electric and magnetic fields which occur in the dielectric material between the strip conductor and the ground plane. Therefore, microstrip line employs the combination of the strip conductor, dielectric material, and ground plane in order to function.

A microstrip line consists of a strip conductor, a conductive ground plane, and a dielectric material sandwiched between the strip conductor and the conductive ground plane. The side of the dielectric material which has the strip conductor on it resembles a printed circuit board. The components used for generating and receiving microwave energy are mounted on this side of the dielectric material and are coupled to the strip conductor. The other side of the dielectric material has only the conductive ground plane on it. Thus, the microwave transceiver 34 is a flat device which can be contained in a narrow housing. All of the foregoing described components are mounted on a planar piece of dielectric material and are coupled to one another via microstrip line.

The microstrip is itself also a microwave circuit component (or element) which, depending upon its physical dimensions and the frequency of the energy, may have resistive, capacitive, and/or inductive properties. The thickness and width of the strip conductor, the thickness of the dielectric material, and the dielectric constant of the dielectric material all determine the properties that the microstrip will exhibit. Thus, the physical dimensions of each microstrip component are important to the circuit's functioning properly.

Figure 7:
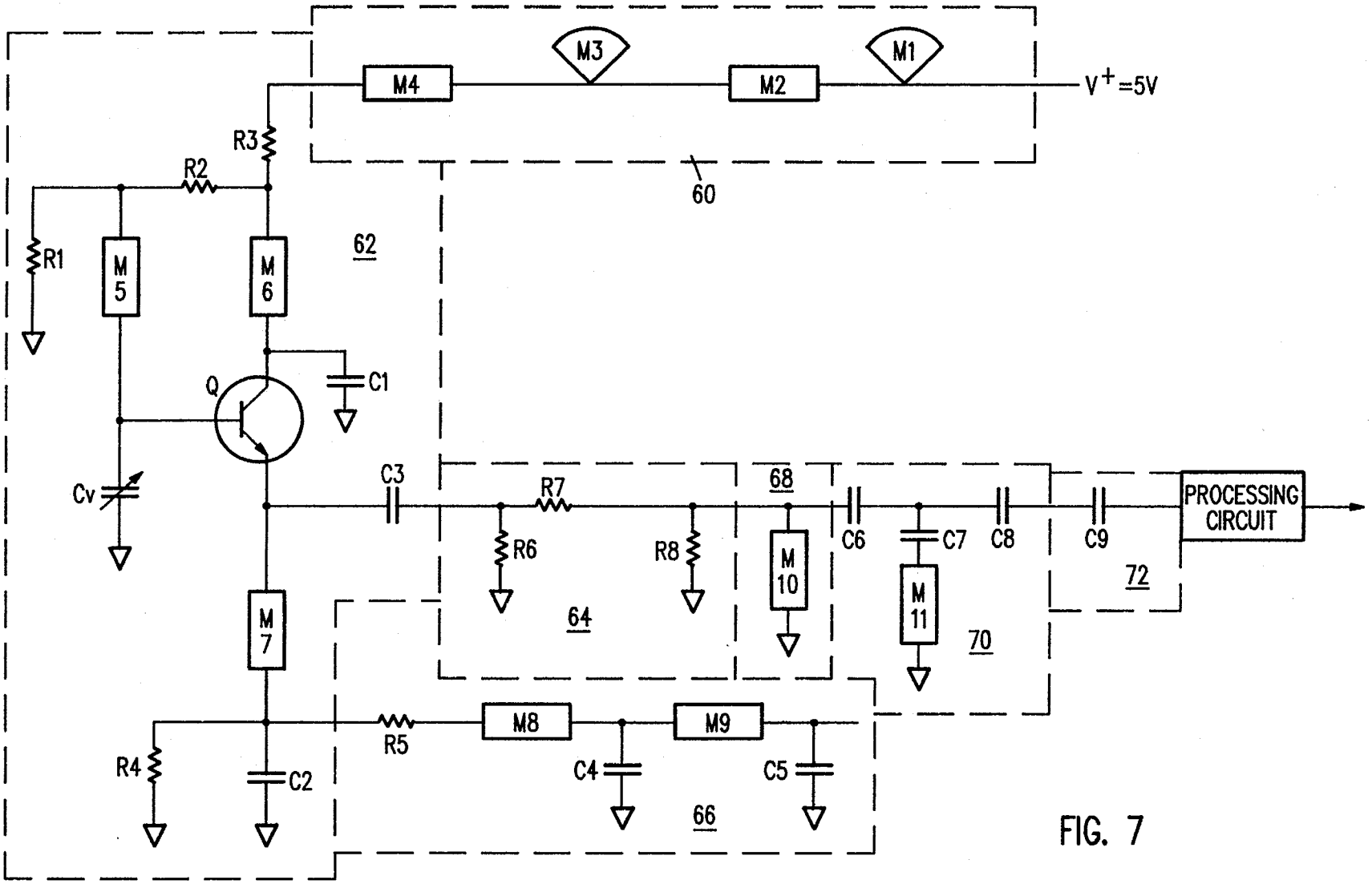
FIG. 7 is a detailed circuit diagram of the microwave detection portion of the intrusion detection system of the present invention.

The microwave transceiver 34 is shown in greater circuit detail in FIG. 7, wherein the following components have their associated values. The microstrips are designated as Mx, with R as being the radius of the microstrip, A being the angle, and L, and W in length and width respectively, all in inches or degree units. Rx is shown in resistance in ohms and Cx is shown in capacitance (pf).

Line Filter 60:
- M1: R=0.200; A=90
- M2: L=0.514; W=0.008
- M3: R=0.133; A=90
- M4: L=0.404; W=0.008

Oscillator 62:
- R1=1.0K
- R2=1.2K
- R3=18
- R4=220
- C1=10
- C2=10
- C3=10
- M5: L=0.610; W=0.008
- M6: L=0.610; W=0.008
- M7: L=0.640; W=0.008

Q=MMBR941L Bipolar transistor from Motorola of Phoenix, Ariz., $C_v$=1.5–3.0, TZB04Z030AB trimmer capacitor from muRata ERIE of State College, Pa., IF Filter 66:
- R5=1.0K
- C4=10
- C5=10
- M8: L=0.600; W=0.008
- M9: L=0.600; W=0.008

Attenuator 64:
- R6=270
- R7=18
- R8=270

Harmonic Filter 68:
- M10: L=0.650; W=0.055

RFI Filter 70:
- C6=1.2
- C7=10
- C8=1.2
- M11: L=0.150; W=0.050

Antenna Match 72:
- C9=1.2

The microwave transceiver 34 is generally less expensive to produce than transceivers of the prior art because the high-frequency silicon bipolar transistor Q is the only active element used in the transceiver 34. The transistor Q is used in the oscillator 62 along with the variable trim capacitor $C_v$ in lieu of a Gunn diode in a wave guide cavity. In addition, because the oscillator 62 is an autodyne component, i.e. it is a self-mixing device, the transistor Q also replaces the Schottky barrier diode found in the receiver section of microwave transceivers of the prior art.

During operation, intrusion detection is accomplished in the following manner. The oscillator circuit 62 generates microwave electromagnetic energy for transmission at a transmission frequency. The transmission frequency, which is generally in the lower portion of the microwave frequency band, preferably falls within the S Band and is about 2.45 GHz. The generated energy propagates to the attenuator circuit 64. After attenuation, the generated energy propagates along microstrip line to the harmonic filter circuit 68. The harmonic filter circuit 68 reflects the undesired second, third, and fourth harmonic content of the generated microwave energy. The reflected energy is dissipated in the attenuator circuit 64 such that it is substantially shunted to ground reference. The undesired harmonics of the generated radiation must be removed in order to comply with Federal Communications Commission (FCC) requirements.

After the undesired harmonics are removed, the fundamental frequency of the generated energy propagates to the microwave antenna 32 where it is radiated into free space. If an object or body is present in the field pattern of the antenna 32, the object will reflect radiation back to the antenna 32. If the object is moving towards or away from the antenna 32, a Doppler Shift will occur and the reflected radiation will have a slightly different frequency than the generated radiation. The reflected radiation is collected by the microwave antenna 32.

The collected energy propagates along microstrip line to the oscillator 62. Oscillator 62, and in particular the transistor Q mixes the collected energy with the generated energy and produces an Intermediate Frequency (IF) signal. The IF signal has a frequency equal to the difference between the frequencies of the generated and collected electromagnetic energy, and is typically in the range 1 to 30 Hz. The IF signal is then sent to the IF filter 66, where the signal is filtered, and then to a processing circuitry 74 which analyzes the signal to determine if an intrusion has occurred. The processing unit 74 may be a circuit which is well known in the art. Such circuitry analyzes the IF signal and detects whether an intrusion (e.g., presence or motion of an object) has occurred within the spatial region irradiated by the transmitted radiation. In the event both PIR detect signal 29 and microwave detect signal 36 are generated, an alarm signal 42 is then generated.

What is claimed is:

1. A location-independent intrusion detection system, comprising:

passive infrared radiation (PIR) intrusion detection means for sensing the infrared radiation of an intruder, said PIR detection means comprising a substantially hemispherically shaped fresnel lens having a plurality of fresnel lens segments, each lens segment for focusing infrared radiation from a field of view, with the plurality of fresnel lens segments focusing infrared radiation from a plurality of spaced apart fields of view from a substantially conically shaped volume of space, with the conically shaped volume of space having an axis perpendicular to the plane of the PIR intrusion detection means, and the volume of space symmetrical about the axis; and microwave transceiver means comprising microwave generating means for generating microwave radiation, a bent monopole antenna for radiating the microwave radiation generated by the microwave generating means into a substantially balloon shaped symmetrical volume of space having an axis, substantially perpendicular to the plane of the microwave transceiver means;

wherein the balloon shaped volume of space of said microwave transceiver means substantially coincides with the conically shaped volume of space of the PIR intrusion detection means.

2. The intrusion detection system of claim 1, wherein said microwave generating means comprises a self-detect oscillating means having a single bipolar transistor and a trimmer capacitor for generating said microwave radiation and for detecting the reflected microwave radiation.

3. The intrusions detection means of claim 2 wherein said microwave transceiver means further comprising IF filter means for receiving said detected reflected microwave radiation from said oscillating means and for generating an IF signal in response thereto.

4. The intrusion detection means of claim 3 wherein said microwave transceiver means further comprising RF filter means, interposed between said oscillating means and said bent monopole antenna for filtering radio frequency from said antenna and said oscillating means.

* * * * *